US006311503B1

(12) United States Patent
Shapiro et al.

(10) Patent No.: US 6,311,503 B1
(45) Date of Patent: Nov. 6, 2001

(54) METHODS AND APPARATUS FOR DETECTING ICE READINESS

(75) Inventors: Andrew Phillip Shapiro; Jerome Johnson Tiemann; William Alan Edelstein, all of Schenectady, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/640,056

(22) Filed: Aug. 17, 2000

(51) Int. Cl.[7] ..... F25C 1/00
(52) U.S. Cl. ..... 62/138; 73/170.26
(58) Field of Search ..... 62/137, 138, 139, 62/175, 59, 156, 303; 340/581; 73/170.26

(56) References Cited

U.S. PATENT DOCUMENTS

| | | | | |
|---|---|---|---|---|
| 3,791,166 | * | 2/1974 | Maleck | 62/138 |
| 4,142,373 | * | 3/1979 | Weibel et al. | 62/138 |
| 4,238,930 | * | 12/1980 | Hogan et al. | 62/138 |
| 4,384,462 | * | 5/1983 | Overman et al. | 62/175 |
| 4,843,830 | * | 7/1989 | Haul | 62/59 |
| 5,460,007 | | 10/1995 | Reed et al. | 62/137 |
| 5,507,154 | * | 4/1996 | Grant | 62/156 |
| 5,606,864 | * | 3/1997 | Jones | 62/139 |
| 5,732,563 | * | 3/1998 | Bethuy et al. | 62/139 |
| 5,752,393 | * | 5/1998 | Schlosser et al. | 62/303 |
| 5,761,920 | * | 6/1998 | Wilson et al. | 62/138 |
| 5,790,026 | * | 8/1998 | Lardiere, Jr. et al. | 340/581 |
| 5,874,672 | * | 2/1999 | Gerardi et al. | 73/170.26 |

* cited by examiner

*Primary Examiner*—Teresa Walberg
*Assistant Examiner*—Leonid M Fastovsky
(74) *Attorney, Agent, or Firm*—Jill M. Breedlove; Christian G. Cabou

(57) ABSTRACT

Accurate sensing of ice readiness in an ice maker is accomplished using, as an ice readiness sensor, a capacitance bridge circuit having a first capacitor connected as a first bridge arm a second capacitor connected as a second bridge arm, a tunable capacitor connected as a third bridge arm and a probe connected as a fourth bridge arm. The probe includes a pair of electrode strips placed in close proximity to the belt of a belt ice maker. First and second bridge arms are connected at a first bridge node first and third bridge arms are connected at a second bridge node, second and fourth bridge arms are connected at a third bridge node, and third and fourth bridge arms are connected at a grounded fourth bridge node. The first and fourth bridge nodes are input terminals for receiving an AC drive signal from an AC source, and the second and third bridge nodes are output terminals. A signal processor, coupled to the second and third bridge nodes, includes an amplifier having its output coupled to a rectifier, and an output filter capacitor coupled to the rectifier. An output signal from the signal processor is supplied to a controller which controls the movement of the belt.

24 Claims, 2 Drawing Sheets

METHODS AND APPARATUS FOR DETECTING ICE READINESS

BACKGROUND OF THE INVENTION

This invention relates generally to automatic ice makers, and more particularly to detecting ice readiness in a belt ice maker which contains water during formation of ice cubes and from which the formed ice cubes are later released.

Refrigerator ice makers typically form ice cubes in the freezer compartment and release the formed ice cubes through a dispenser located in a freezer compartment door. Refrigerator ice makers of the elastomer belt type include an elastomer belt, or mold, having a plurality of cube compartments. Water freezes in the cube compartments to form ice cubes, and the fully frozen cubes are discharged, or released, from the cube compartments into a container. Belt ice makers do not require as much space as, and have a higher ice rate, (i.e., make more ice) than, many other types of ice makers.

Although belt ice makers provide the advantages mentioned above, determining whether ice is completely frozen in a belt ice maker is difficult. Specifically, a temperature measurement typically is utilized to determine whether water in a cube compartment is completely frozen and ready to be dispensed. In a belt ice maker, however, the mold moves and has a low thermal conductivity. Therefore, a thermistor, thermocouple, or other temperature sensor has to be in sliding contact with the mold, and accuracy of a temperature sensed is impacted by freezer air temperature and air velocity.

Releasing less than completely frozen ice cubes into a container in a freezer is not desirable since the unfrozen water then freezes in the container and multiple cubes may be frozen together. Also, unnecessarily maintaining fully frozen ice cubes in a mold adversely impacts the ice rate of the ice maker.

SUMMARY OF THE INVENTION

An exemplary embodiment of an ice readiness sensor for accurately sensing ice readiness in an ice maker includes a capacitance bridge circuit, or bridge, having a first impedance as a first bridge arm, a second impedance as a second bridge arm, a tunable capacitor as a third bridge arm, and a probe as a fourth bridge arm. The probe includes electrode strips that can be placed in close proximity to an ice maker belt, and develops a capacitance which depends, at least in part, on dielectric properties of contents of the ice cube compartment. The term "close proximity" as used herein means that the electrode strips are sufficiently close to air/water in the ice cube cavity so that the dielectric constant of the medium in the cavity affects the capacitance developed by the electrodes.

The first and second bridge arms are connected at a first bridge node, the first and third bridge arms are connected at a second bridge node, the second and fourth bridge arms are connected at a third bridge node, and the third and fourth bridge arms are connected at a grounded fourth bridge node. The first and fourth bridge nodes are input terminals for receiving an AC drive signal from an AC source, and the second and third bridge nodes are output terminals.

A signal processing unit coupled to the second and third bridge nodes includes an amplifier whose output is coupled to a rectifier by a coupling capacitor. In the exemplary embodiment, the amplifier is a differential amplifier which generates an output signal that varies in amplitude in direct relation to the extent by which the capacitance of the probe differs from the capacitance of the tunable capacitor. A filter capacitor is coupled to the rectifier output so that a voltage across the capacitor is proportional to the amplifier output signal amplitude. An output signal from the processing unit is supplied, for example, to a controller.

The ice readiness sensor is calibrated so that the bridge circuit is balanced when the ice cube cavity directly above the probe is empty; i.e., when such cube cavity is empty, voltage across the bridge is zero, or nearly zero. When water is in such cube cavity, the probe capacitance increases because the dielectric constant of water is 80 times that of air. As a result, the bridge becomes unbalanced and the voltage signal sensed by the amplifier increases as compared to the signal when air is in the cube cavity. As the water freezes, the dielectric constant of the water decreases to about six times that of air and therefore, as the water freezes, the imbalance of the bridge decreases as does the signal sensed by the amplifier.

The above described ice readiness sensor is particularly well suited for use with a belt ice maker since the sensor does not need to be in physical contact with ice or an ice mold. In addition, since the sensor is a capacitance sensor rather than a temperature sensor, the sensor accuracy is not impacted by freezer air temperature and air velocity. Such accuracy facilitates achieving desired ice rates as well as avoiding release of less than completely frozen ice cubes into an ice container.

DETAILED DESCRIPTION OF THE INVENTION

While ice readiness apparatus and methods are described herein in the context of residential, (or domestic) refrigerators, they can, nevertheless, be utilized in connection with commercial refrigerators and with stand-alone ice makers, i.e., ice makers that are not part of a larger freezer compartment or refrigerator. Therefore, these ice readiness apparatus and methods are not limited to use only with ice makers for residential refrigerators, and can be utilized with ice makers in many other environments.

Figure 1:
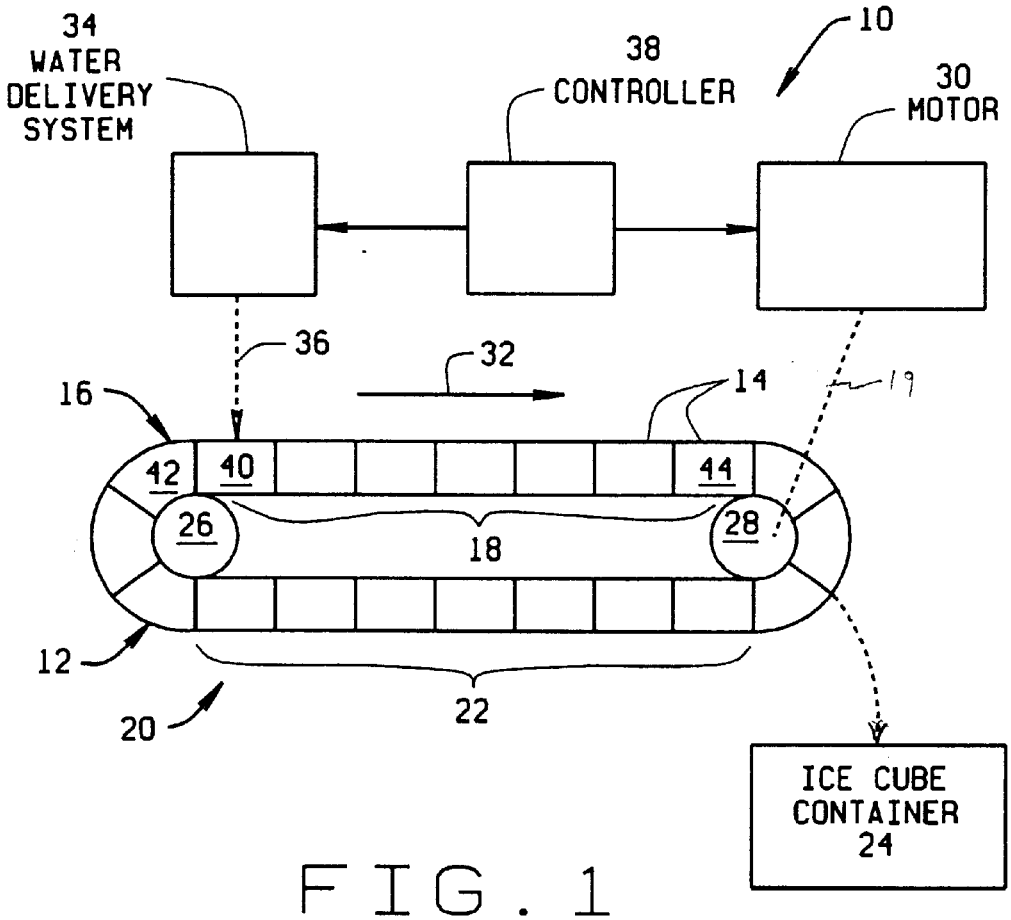
FIG. 1 is a schematic illustration of a belt icemaker.

FIG. 1 is a schematic illustration of a belt ice maker 10, typically located in a freezer compartment of a refrigerator and including an elastomer belt, or mold, 12 that defines a plurality of cube cavities or compartments 14. A section 16 of mold 12 is in a first position in which first cube cavities 18 face generally upward and a section 20 of mold 12 is in a second position in which second cube cavities 22 face generally downward. Ice cubes are released or ejected, under gravitational force, from mold 12 and into a cube container 24.

Belt 12 is driven on rollers 26 and 28. Roller 28 is coupled to a stepper motor 30 by a drive shaft 19, shown schematically. Belt 12 moves, under control of motor 30, in a direction indicated by an arrow 32. Ice maker 10 also includes a water delivery system 34 for delivering water to each cavity 14 as each cavity 14 moves into a first position indicated by arrow 36. A controller 38, e.g., a programmable processor, controls water delivery source 34 and motor 30 to operate as described below.

In operation, and with mold 12 initially empty, controller 38 causes water delivery system 34 to fill cube cavity 40 at first position 36, i.e., with water. Since all other cavities 14 are empty, controller 38 causes motor 30 to advance belt 12 one increment so that the next cavity 42 is aligned with water delivery system 34. Cavity 42 is then filled with water by system 34. This process continues until a cube cavity having water therein is next in position for being dispensed, e.g., cube cavity 44 as shown in FIG. 1.

Controller 38 enables motor 30 to advance belt 12 only when the water in cube cavity 44 is frozen and ready to be dispensed. Once it is determined that the water in cube cavity 44 is frozen and ready to be dispensed, motor 30 causes belt 12 to advance one increment. This process continues in the above fashion until ice cube container 24 is full.

When cube container 24 is full, controller 38 does not enable motor 30 to advance belt 12. Ice cube level detectors for determining whether ice cubes in container 34 are at or above a predetermined level are known. In the embodiment shown in FIG. 1, such a level detector (not shown) is coupled to controller 38. As cubes are removed from cube container 24, e.g., via a dispenser in a freezer door, a demand for additional cubes is determined based on an output signal from the level detector supplied to controller 38, and controller 38 then enables motor 30 to resume advancing belt 12 as described above.

Determining whether ice is completely frozen in a belt ice maker is difficult since a simple temperature measurement cannot be easily obtained to determine whether the water in a cavity is completely frozen. Specifically, the ice maker belt moves and has a low thermal conductivity. Therefore, accuracy of a thermistor, thermocouple, or other temperature sensor in sliding contact with the belt would be impacted by freezer air temperature and air velocity.

In one aspect of the invention, an ice readiness sensor is provided for determining the readiness of ice being formed in a belt ice maker. The sensor is not directed to, nor limited to practice with, any particular belt ice maker or freezer, and can be used in connection with many ice makers other than the above described belt ice maker.

Figure 2:
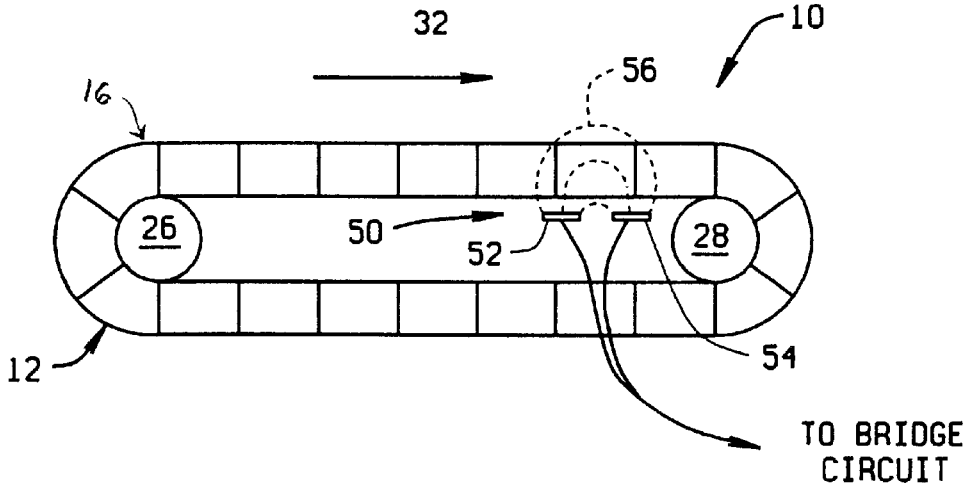
FIG. 2 is a schematic illustration of the belt ice maker shown in FIG. 1 including a capacitance probe in accordance with one embodiment of the invention.

FIG. 2 is a schematic illustration of belt ice maker 10 of FIG. 1 including a capacitance probe 50 in accordance with one embodiment of the invention. Probe 50 includes conductive electrodes 52 and 54 in the form of strips that extend substantially parallel to each other. When probe 50 is energized, an electric field 56 is established between probe strips 52 and 54. Strips 52 and 54 are located in proximity to, and beneath, first section 16 of belt 12 containing ice cube cavities, as shown in FIG. 2. Strips 52 and 54 could, alternatively, be located over belt 12. The specific location of strips 52 and 54 relative to belt 12, i.e., over or under belt 12, is selected depending upon the particular ice maker configuration and also as a matter of installation convenience.

In one specific embodiment, each strip 52 and 54 has a width of about 0.5 inches and a length sufficient to span the width of belt 12. Strips 52 and 54 are spaced about 0.5 inches apart, i.e., distance from the inner edge of one strip 52 to the inner edge of the other strip 54 is about 0.5 inches. The width and spacing of strips 52 and 54 is selected based on the distance of probe 50 from belt 12 and the thickness of the medium to be sensed. Higher sensitivity can be provided by utilizing an interdigitated pattern for electrodes 52 and 54. Strips 52 and 54 are of metallic composition, such as copper or aluminum, or are conductive polymers. A specific location and configuration for probe 50 for a particular ice maker can be determined empirically.

Figure 3:
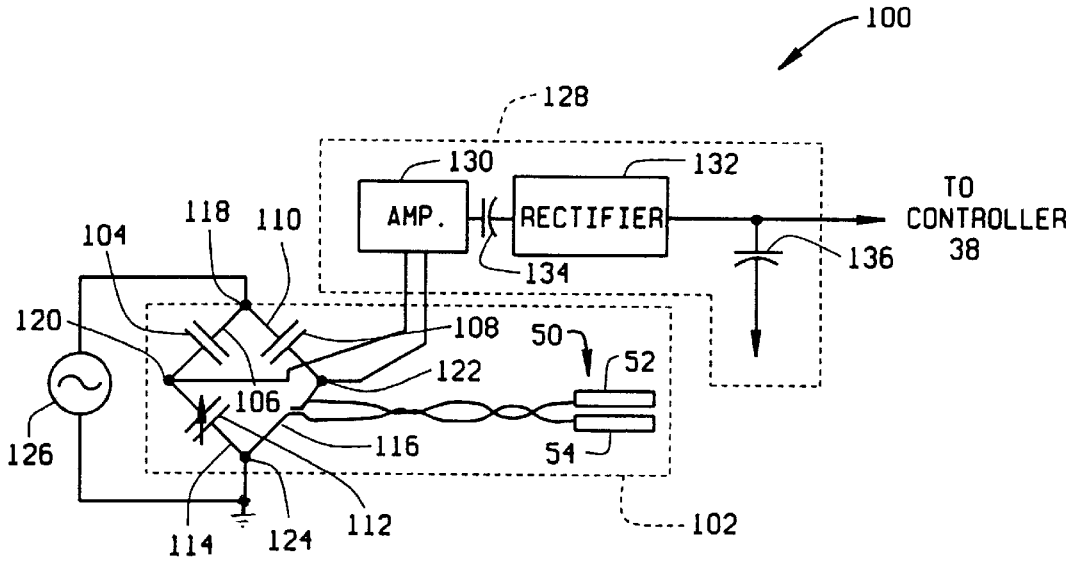
FIG. 3 is a circuit schematic illustration of an ice readiness sensor in accordance with one embodiment of the present invention.

FIG. 3 is a circuit schematic illustration of an ice readiness sensor 100 in accordance with one embodiment of the present invention. Sensor 100 includes a capacitance bridge circuit 102 having a capacitor 104 as a first impedance in a first bridge arm 106, and a capacitor 108 as a second impedance in a second bridge arm 110. The impedences of first and second bridge arms 106 and 110 can, for example, be not only capacitors, but also resistors, or both capacitors and resistors. A tunable capacitor 112 is connected in a third bridge arm 114, and probe 50, i.e., first electrode 52 and second electrode 54, is connected in a fourth bridge arm 116. Probe 50 is essentially a capacitor with electrodes 52 and 54 being the capacitor plates while the air and the cube cavity between the electrodes, together with the cube cavity contents, act as the dielectric.

First and second bridge arms 106 and 110 are connected at a first bridge node 118, first and third bridge arms 106 and 114 are connected at a second bridge node 120, second and fourth bridge arms 110 and 116 are connected at a third bridge node 122, and third and fourth bridge arms 114 and 116 are connected at a grounded fourth bridge node 124. First and fourth bridge nodes 118 and 124 are bridge input terminals for receiving an AC drive signal from an AC source 126, and second and third bridge nodes 120 and 122 are bridge output terminals. In an exemplary embodiment, AC drive signal is a 100 kHz signal.

A signal processor unit 128 is coupled to second and third bridge nodes 120 and 122. Signal processor unit 128 includes an amplifier 130 coupled to a rectifier 132 by a coupling component 134, such as a capacitor. Amplifier 130 is a differential amplifier which generates an output signal that varies in amplitude in relation to the extent by which the capacitance of probe 50 differs from the capacitance of tunable capacitor 112. A filter capacitor 136 is coupled to the output of rectifier 132. An output signal from signal processor 128 is supplied, for example, to controller 38 (FIG. 1).

Ice readiness sensor 100 is calibrated so that when mold 12 is empty, bridge 102 is balanced, i.e., the voltage across bridge nodes 120 and 122 is zero, or nearly zero. When water is in mold cavity 44 just above probe 50 (FIGS. 1 and 2), the capacitance of probe 50 increases because the dielectric constant of water is 80 times that of air. As a result, bridge 102 becomes unbalanced and the voltage signal sensed by amplifier 130 increases as compared to when air is in mold 12.

As the water in cavity 44 freezes, the dielectric constant of the water decreases to about six times that of air. Therefore, as the water freezes, the imbalance of bridge 102 decreases, as does the signal sensed by amplifier 130.

In an alternative embodiment, ice readiness sensor 100 is calibrated so that bridge 102 is balanced when water is in mold cavity 44 just above probe 50 (FIGS. 1 and 2). In the alternative embodiment, as the water in cavity 44 freezes, the voltage signal generated by amplifier 130 increases.

In both embodiments described above, there exists a monotonic relationship between the amplifier output signal amplitude and the proportion of ice and water in the mold. Thus, comparison of a voltage across the filter capacitor with a fixed threshold (e.g., which can be determined empirically for each particular mold) can unambiguously indicate that the ice is completely frozen.

In another aspect, the invention is directed to a method for determining ice readiness. The method can be practiced utilizing the ice readiness sensor illustrated in FIG. 3 in combination with a belt ice maker as shown in FIG. 1. The method is not limited to practice only with such sensor and belt ice maker, and can be used with other apparatus.

The method includes the steps of placing electrodes in close proximity to an ice cube cavity and sensing the capacitance developed across the electrodes. Ice in the ice cube cavity is determined to be ready once the capacitance across the electrodes reaches, and thereafter remains below, a predetermined level, e.g., when the dielectric constant decreases to about six times that of air.

The above described apparatus and methods for detecting ice readiness are particularly well suited for use in combination with a belt ice maker since the apparatus and methods do not require that a sensor be in physical contact with ice or an ice mold. In addition, since the apparatus and methods are based on measurement of a capacitance rather than a temperature, the accuracy of such apparatus and methods is not impacted by freezer air temperature and air velocity.

While only certain preferred features of the invention have been illustrated and described, many modifications and changes will occur to those skilled in the art. It is, therefore, to be understood that the appended claims are intended to cover all such modifications and changes as fall within the true spirit of the invention.

What is claimed is:

1. An ice readiness sensor comprising:

a bridge circuit comprising a first impedance connected as a first bridge arm, a second impedance connected as a second bridge arm, a tunable capacitor connected as a third bridge arm, and a first electrode and a second electrode connected in a fourth bridge arm, said first and second electrodes being capacitor electrodes and including therebetween an ice cube cavity as a capacitor dielectric, said first and second bridge arms connected at a first bridge node, said first and third bridge arms connected at a second bridge node, said second and fourth bridge arms connected at a third bridge node, said third and fourth bridge arms connected at a grounded fourth bridge node, said first and fourth bridge nodes comprising input terminals for receiving an AC drive signal, and said second and third bridge nodes comprising output terminals; and a signal processor coupled to said second and third bridge nodes.

2. An ice readiness sensor in accordance with claim 1 wherein at least one of said first and second impedances comprises a capacitor.

3. An ice readiness sensor in accordance with claim 1 wherein at least one of said first and second impedances comprises a resistor.

4. An ice readiness sensor in accordance with claim 1 wherein said first and second electrodes comprise parallel electrode strips, situated in proximity to said ice cube cavity.

5. An ice readiness sensor in accordance with claim 1 wherein said signal processor unit comprises a differential amplifier having an output coupled to a rectifier, and a filter capacitor coupled to an output of said rectifier.

6. An ice readiness sensor for determining readiness of ice in an ice cube cavity, said sensor comprising:

a probe for positioning relative to the ice cube cavity so that a medium contained within the cavity affects capacitance developed across said probe; and a signal processor coupled to said probe for processing a signal representative of capacitance developed across said probe.

7. An ice readiness sensor in accordance with claim 6, further comprising a four arm bridge circuit, said probe being connected in one arm of said bridge circuit.

8. An ice readiness sensor in accordance with claim 7, wherein said bridge circuit further comprises a first impedance connected as a first bridge arm, a second impedance connected as a second bridge arm, a tunable capacitor connected as a third bridge arm, and said probe connected as a fourth bridge arm, said first and second bridge arms connected at a first bridge node, said first and third bridge arms connected at a second bridge node, said second and fourth bridge arms connected at a third bridge node said third and fourth bridge arms connected at a grounded fourth bridge node, said first and fourth bridge nodes comprising input terminals for receiving an AC drive signal, and said second and third bridge nodes comprising output terminals.

9. An ice readiness sensor in accordance with claim 8 wherein at least one of said first and second impedances comprises a capacitor.

10. An ice readiness sensor in accordance with claim 8 wherein at least one of said first and second impedances comprises a resistor.

11. An ice readiness sensor in accordance with claim 8 wherein said signal processor is coupled to said second and third bridge nodes.

12. An ice readiness sensor in accordance with claim 6 wherein said probe comprises first and second parallel electrodes situated in proximity to said ice cube cavity.

13. An ice readiness sensor in accordance with claim 12 wherein said first electrode comprises a first electrode strip and said second electrode comprises a second electrode strip.

14. An ice readiness sensor in accordance with claim 6 wherein said signal processor comprises an amplifier having an output coupled to a rectifier, and a filter capacitor coupled to an output of said rectifier.

15. A method for determining readiness of ice to be dispensed from an ice cube cavity of a mold, said method comprising the steps of:

placing first and second electrodes relative to the ice cube cavity so that contents in the cavity affects capacitance across the electrodes;

sensing capacitance developed across the electrodes; and determining that ice in the cavity is ready to be dispensed when the capacitance across the electrodes reaches, and thereafter remain below, a predetermined level.

16. A method in accordance with claim 15 wherein the mold is a component of a belt ice maker, the first and second electrodes are positioned under at least a portion of the mold, and the first and second electrodes are coupled in an arm of a bridge circuit, and wherein the step of sensing a capacitance developed across the electrodes comprises sensing an output signal across the bridge circuit.

17. A method in accordance with claim 16 wherein the bridge circuit is balanced when the only contents of the cavity is air.

18. A method in accordance with claim 16 wherein the bridge circuit is unbalanced when the contents of the cavity comprise at least one of the group consisting of water and ice.

19. A method in accordance with claim 16 wherein the bridge circuit is balanced when the contents of the cavity (44) comprise only liquid water.

20. An ice maker for delivering frozen ice cubes into a container, comprising:

a belt having a plurality of cube cavities therein, said belt being adapted to be situated in an environment of below freezing temperature;

a water delivery system for filling said cube cavities with water;

an ice cube delivery system for accepting ice cubes from the cube cavities of said belt;

a motor for moving said belt so that said cube cavities pass from said water delivery system to said ice cube delivery system;

a pair of parallel electrodes situated in proximity to said belt;

means for sensing capacitance across said electrodes, said capacitance being dependent upon contents of whichever of said cube cavities is in closest proximity to said belt; and means responsive to the sensed capacitance for controlling said motor to allow movement of said belt when sensed capacitance in conjunction with any one of said cube cavities indicates that said any one of said cavities contains only ice.

21. The ice maker of claim 20 wherein said means for sensing capacitance across said electrodes comprises a bridge circuit having first impedance connected as a first bridge arm, a second impedance connected as a second bridge arm, a tunable capacitor connected as a third bridge arm, and said pair of parallel electrodes connected in a fourth bridge arm, said first and second bridge arms connected at a first bridge node, said first and third bridge arms connected at a second bridge note, said second and fourth bridge arms connected at a third bridge node, said third and fourth bridge arms connected at a grounded fourth bridge node, said first and fourth bridge nodes comprising input terminals for receiving an AC drive signal, and said second and third bridge nodes comprising output terminals; and a signal processor coupled to said second and third bridge nodes.

22. An ice maker in accordance with claim 21 wherein at least one of said first and second impedances comprises a resistor.

23. An ice maker in accordance with claim 21 wherein at least one of said first and second impedances comprises a resistor.

24. An ice maker in accordance with claim 21 wherein said signal processor unit comprises a differential amplifier having an output coupled to a rectifier, and a filter capacitor coupled to an output of said rectifier.

* * * * *